United States Patent [19]

Allen et al.

[11] 3,998,436

[45] Dec. 21, 1976

[54] MOBILE CONCRETE BATCH PLANT

[75] Inventors: Albert J. Allen, Clintonville, Wis.; Arthur D. Davis, Champaign, Ill.; James J. Fasimpaur, Englewood, Ohio; Fred A. Goglia, Urbana; Cecil A. Pike, Mahomet, both of Ill.

[73] Assignee: Koehring Company, Milwaukee, Wis.

[22] Filed: Feb. 28, 1974

[21] Appl. No.: 446,671

[52] U.S. Cl. ..... 259/154; 198/505; 214/2

[51] Int. Cl.[2] ..... B01C 5/02

[58] Field of Search ..... 259/149, 154, 164, 165, 259/168, 161, 162, 163, 169, 170; 214/2; 222/136; 198/39

[56] References Cited

UNITED STATES PATENTS

| | | | |
|---|---|---|---|
| 2,288,099 | 6/1942 | Mason | 198/39 |
| 2,857,151 | 10/1958 | Brabender | 198/39 |
| 3,162,316 | 12/1964 | Camp | 259/154 |
| 3,251,484 | 5/1966 | Hagan | 259/154 |
| 3,476,270 | 11/1969 | Cox | 214/2 |

*Primary Examiner*—Robert W. Jenkins
*Attorney, Agent, or Firm*—Burns, Doane, Swecker & Mathis

[57] ABSTRACT

A mobile concrete batch plant for supplying a properly proportioned homogenous mix of cement and aggregate (including sand) to a mix truck from an elevated discharge hood comprises a weigh bin for receiving and weighing aggregate from an aggregate storage bin and for depositing a weighed batch of aggregate onto a belt conveyor for transport to and discharge from a discharge opening in the discharge hood. The plant further comprises a combined screw conveyor and weigh batcher for receiving and weighing cement from a cement storage bin and for transporting and discharging a weighed batch of cement through a cement pipe concentric of the discharge opening in the discharge hood simultaneously with the discharge of the aggregate.

10 Claims, 4 Drawing Figures

MOBILE CONCRETE BATCH PLANT

BACKGROUND OF THE INVENTION

1. Field of Use

This invention relates to mobile concrete batch plants for mixing cement and aggregate (including sand) in proper proportions at a job site and for depositing the mix into mix trucks.

2. Description of the Prior Art

Mobile concrete batch plants of various types are disclosed in the prior art. The typical plant comprises a large framework having ground wheels and a tow hitch to enable the plant to be transported to and from a job site. Discharge means are located on the framework in an elevated position to supply mix trucks driving therebeneath. A cement storage bin and an aggregate storage bin are mounted on the framework and are adapted to be loaded by suitable means such as front end loaders or the like. Means are provided to supply measured quantities or batches of cement and aggregate from the storage bins to the discharge means for deposit into the mix trucks.

U.S. Pat. No. 3,207,327, issued Sept. 21, 1965 to R. F. Long for "Concrete Batch Plant" shows a prior art plant wherein sand and aggregate are transported from their storage bins by separate belt conveyors to belt-type conveyor scales for weighing and for subsequent deposit into a discharge bin located therebelow. Cement is transported from a cement storage bin by an upwardly inclined screw conveyor to the top of a cement weigh bin wherein it is weighed prior to deposit into the discharge bin located therebelow along with the aggregate and sand. The mix in the discharge bin is then discharged onto the lower end of an upwardly inclined belt conveyor for final delivery to the elevated discharge means to supply the mix trucks.

U.S. Pat. No. 3,476,270, issued Nov. 4, 1969 to G. W. Cox et al. for "Mobile Concrete Batching Plant" shows another type of plant wherein an aggregate bin at the rear of the plant discharges into an aggregate weigh bin located therebelow and the latter discharges onto the lower end of an upwardly inclined belt conveyor which conveys the aggregate to the elevated discharge means at the front of the plant. The discharge means assume an elevated position when the front end of the plant is raised and supported in working position at the job site. Cement is transported from a cement storage bin by an upwardly inclined screw conveyor which discharges cement into the top of a cement weigh bin located above the elevated discharge means and wherein the cement is weighed prior to deposit into the discharge means along with the aggregate for delivery to the mix truck.

Each of the prior art plants requires a relatively large cement weigh bin (filled from the top and emptied from the bottom) wherein a batch of cement is weighed. In the Long patent the use of a cement weigh bin as shown necessitates a final upwardly inclined conveyor in order to deliver the mix to the mix truck, and this extends the overall length of the plant. In the Cox et al. patent the large cement weigh bin, being located above the elevated discharge means, requires extra headroom at the discharge end of the plant. Experience has also shown that other problems result from use of conventional cement weigh bins. For example, the discharge of cement from the discharge opening of a conventional cement weigh bin tends to be erratic and to lack continuity because the dry cement, although initially aerated to a loose and fluffy condition to encourage good flow characteristics, tends to lose its entrained air in the weigh bin and tends to arch above the weigh bin discharge opening. Use of additional air or vibration to loosen the cement, besides increasing the cost and complexity of batch plants, also results in irregular surges of cement through the weigh bin discharge opening and adds to the difficulty of controlling dry batch weighing of mix trucks.

SUMMARY OF THE PRESENT INVENTION

An improved mobile concrete batch plant in accordance with the present invention comprises a wheeled supporting framework adapted for towing while in the horizontal road transport position and further adapted to have one end raised to a working position at the job site to accommodate mix trucks therebeneath. The plant comprises a discharge hood located at the raised or elevated end of the framework. The discharge hood comprises a discharge opening through which aggregate flows and further accommodates a cement pipe located concentrically of the discharge opening. A cement storage bin is mounted on the framework near the front end thereof and a multi-compartment aggregate storage bin is located on the framework directly behind the cement storage bin and near the rear end of the framework. Each storage bin is provided with an electrically controlled discharge valve or gate. An aggregate weigh bin or batches is mounted near the rear end of the framework and located below the aggregate storage bin and is adapted to receive and weigh a batch of aggregate from the storage bin and to deposit it on a belt conveyor which transports it to the discharge hood. The weigh bin is provided with an electrically controlled discharge valve or gate. The belt conveyor assumes an upwardly inclined position when the framework is elevated. The plant further comprises a combined screw conveyor and cement weigh batcher which is located below the cement storage bin and above the belt conveyor. The combined screw conveyor and weigh batcher comprises a tubular housing having an inlet and outlet and a motor driven screw within the housing. The screw conveyor, which also assumes an upwardly inclined position when the framework is elevated, has its lower inlet connected to the cement storage bin by a two-stage fill valve. The screw conveyor has its upper outlet connected to the cement pipe in the discharge hood. The aggregate weigh bin and the screw conveyor-weigh batcher are each provided with separate scale means and each scale means comprises a dial which gives a visual readout and can also effect automatic shut-off of the discharge valve of the associated storage bin when a predetermined batch weight of material is discharged from the storage bin. During automatic operation, the two-stage valve is partially closed as the full batch weight of cement approaches to provide for accurate control and delivery. In operation, when the aggregate weigh bin has weighed out a desired batch of aggregate and when the screw conveyor-weigh batcher has weighed out a desired batch of cement the belt conveyor and the screw conveyor then operate in proper sequence to deliver their respective materials simultaneously to the discharge hood wherein flow of the cement from the cement pipe is concentric to the flow of aggregate through the discharge hood opening to ensure a thorough mix and dust-free delivery of dry materials entering the mix truck.

A concrete batch plant in accordance with the present invention overcomes the aforedescribed disadvantages of the prior art plants and has other advantages hereinafter described. For example, since a plant in accordance with the invention does not require a conventional cement weigh bin, the overall length and height of the plant can be substantially reduced as compared to conventional plants of a comparable capacity. Furthermore, use of a combined screw conveyor-cement weigh batcher eliminates the need for a separate cement weigh bin, thus reducing the cost and complexity of the plant, as well as eliminating the aforedescribed cement flow problems encountered in the discharge opening of conventional cement weigh bins. In addition, use of a twostage valve between the cement storage bin and the lower input end of the combined screw conveyor-weigh batcher permits a controlled flow of cement into the screw conveyor as the cement scale dial indicator moves toward a precise pre-set weight. Furthermore, the flights in the screw conveyor assert a metering action and produce an even flow of cement from the outlet at the discharge end of the screw conveyor into the discharge hood. Another advantage resulting from the upwardly inclined combined screw conveyor-weigh batcher having an inlet at its lower end is that the screw action ensures that the conveyor housing wherein the cement is weighed is completely emptied of residual cement prior to admittance of the next batch of cement which is to be weighed. Other objects and advantages of the invention will hereinafter appear.

DRAWINGS

DESCRIPTION OF A PREFERRED EMBODIMENT

Figure 1:
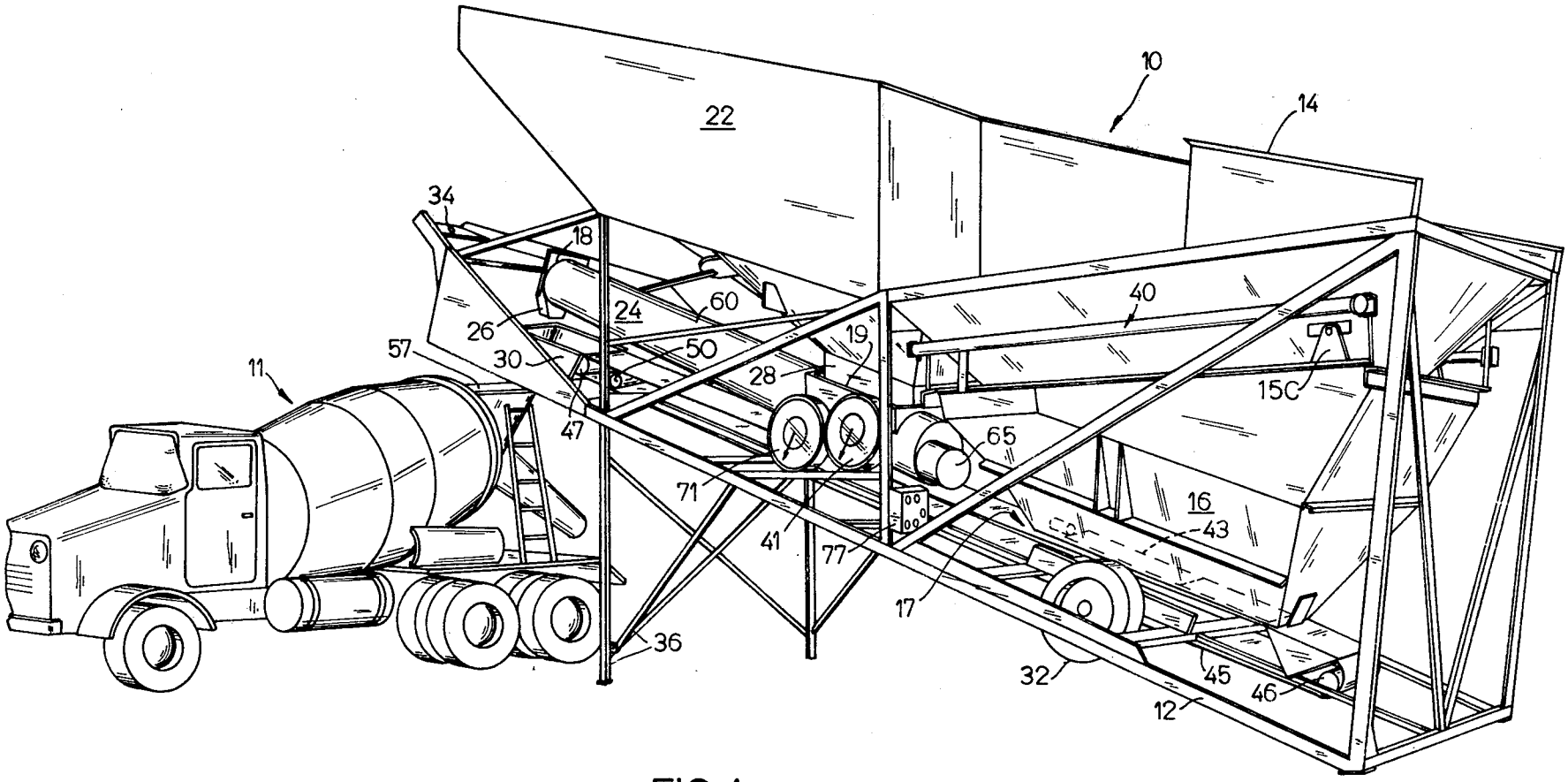
FIG. 1 is a perspective view taken from the left rear of a mobile concrete batch plant in accordance with the invention shown in association with a transport mix cement truck being loaded therefrom.
Figures 2, 3:
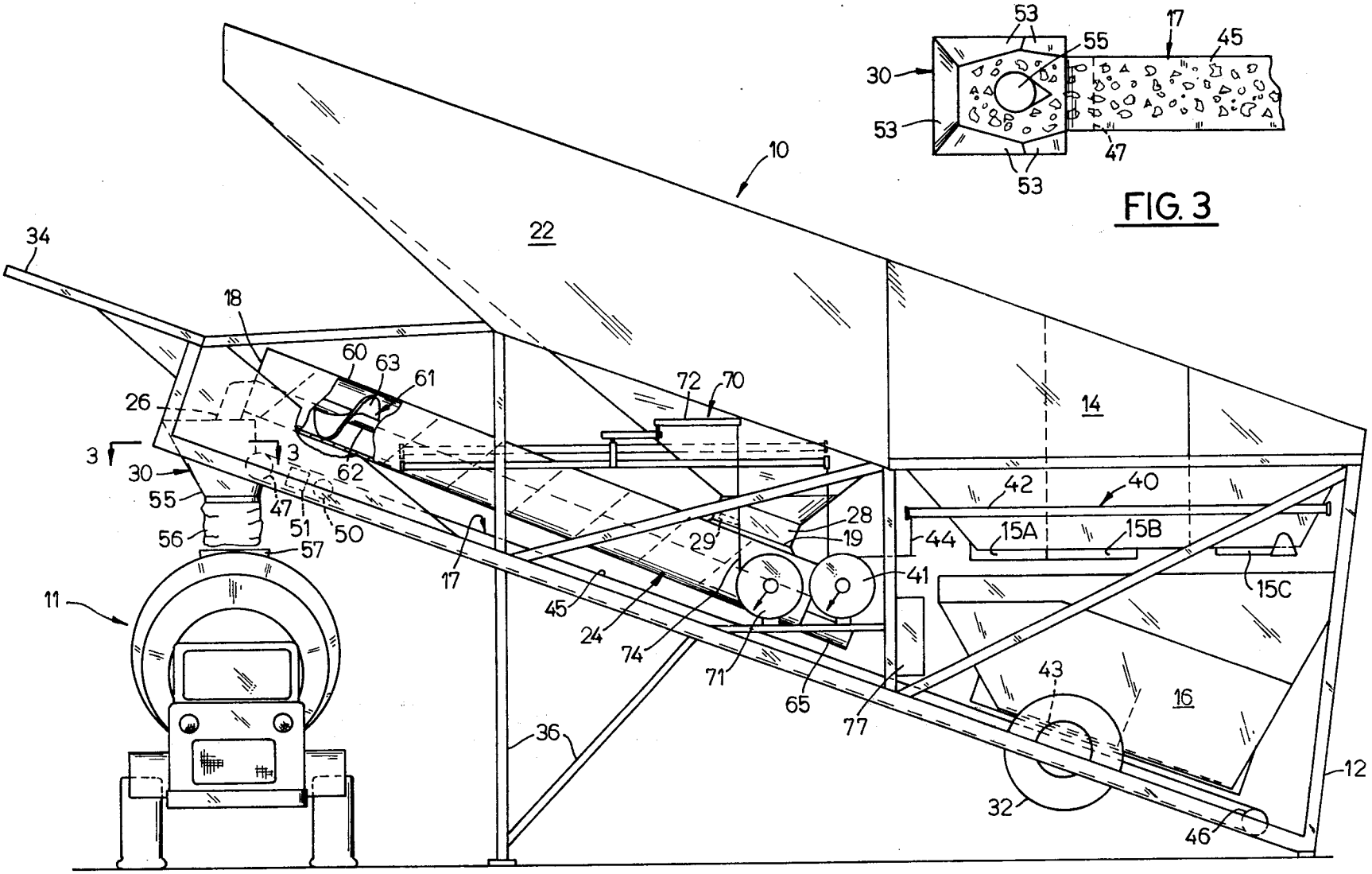
FIG. 2 is a simplified schematic or diagrammatic view of the left side of the plant shown in FIG. 1.
FIG. 3 is a cross-section view of the discharge hood and cement pipe taken on line 3—3 of FIG. 2.

FIGS. 1 and 2 show a mobile concrete batch plant 10 in accordance with the invention for supplying a dry mix of cement and aggregate (including sand) and necessary water to a transit mix truck 11. Generally considered, plant 10 comprises a structural steel supporting framework 12 having a front end and a rear end and on which various components hereafter described are mounted. Plant 10 is shown in on-site working position wherein the front end of the framework 12 is supported in raised position by means of detachable legs or braces 36 which place a discharge hood 30 mounted on the bottom front end of framework 12 in a sufficiently high position to accommodate mix truck 11 therebeneath. Plant 10 is adapted for over-the-road-transport when in lowered position by means of a pair of rear wheels 32 which engage the ground when framework 12 is lowered and by means of a tow truck hitch 34 near the front end of framework 12.

Framework 12 supports an aggregate storage bin 14 near the upper rear end thereof. An aggregate weigh bin or batcher 16 is mounted near the lower rear end of framework 12. A belt type aggregate conveyor 17, driven by an electric motor 50 on the head end of the conveyor, extends from rear to front near the bottom of framework 12 and is supported thereon. A cement storage bin 22 is mounted near the upper front end of framework 12 ahead of aggregate storage bin 14. A combined screw conveyor and cement weigh batcher 24, driven by an electric motor 65, for weighing and conveying cement is supported on framework 12 and extends from rear to front between storage bin 22 and conveyor 17. A cement pipe 26 is connected to a cement discharge outlet 18 at the raised front end of screw conveyor 24. A two-stage electrically controlled fill valve 28 is connected between the discharge outlet of bin 22 and the receiving inlet 19 on the upper side of the lower rear end of screw conveyor 24.

In an actual embodiment, plant 10 is on the order of 44 feet long, 13 feet 6 inches high (when being towed) and 11 feet wide and has an empty weight of about 12 tons. Furthermore, for example, plant 10 is capable of producing 65 to 100 cubic yards of dry mix per hour (depending on operating speed) and assuming the following component capacities: aggregate storage bin 14 (16 cubic yards or 24 tons); aggregate weigh bin 16 (15 cubic yards); cement storage bin 22 (208–255 barrels); and combined screw conveyor-weigh batcher 24 (5 cubic yards).

Belt conveyor 17 comprises a flexible endless belt 45 which passes around suitable rollers 46 and 47 at the rear and front ends of the lower portion of framework 12. Roller 47 is driven by electric motor 50 which is mounted on framework 12 and connected to roller 47 as by a gear box drive 52. Roller 47 is disposed adjacent to a side of discharge hood 30 into which belt conveyor 17 discharges its aggregate when plant 10 is in operation.

As FIGS. 2 and 3 show, discharge hood 30 comprises four downwardly and inwardly tapering walls 53 which terminate in and define a discharge opening 55 at the lower end of the discharge hood. The lower end of discharge hood 30 is provided with a flexible shroud 56 for directing the contents being discharged from hood 30 into mix truck 11. The bottom opening of the cement pipe 26 at the end of screw conveyor-weigh batcher 24 is disposed above, but concentric with, the discharge opening 55 in hood 30 so as to permit the aggregate passing through hood 30 to encircle and surround the cement passing through the discharge hood and thereby cause a certain amount of pre-mix action and also minimize dusting as the mixed materials are deposited into the load hopper 57 on mix truck 11.

The combined screw conveyor-weigh batcher 24 is, for example, on the order of 2" in diameter and comprises a cylindrical casing or housing 60 in which a screw 61 is rotatably mounted. The screw 61 comprise a shaft 62 on which flights 63 are mounted and the shaft is driven by electric motor 65 at the lower rear end of conveyor 24. Motor 65 operates gear box drive 51 so as to enable shaft rotation at a desired speed to determine the discharge rate of cement from the screw conveyor-weigh batcher 24. The two-stage valve 28 is connected between the discharge opening at the bottom rear end of cement storage bin 22 and the receiving opening on the top of the housing 60 near the lower rear end of conveyor 24. The two-stage valve 28 is electrically controlled and can be operated in any suitable manner such as by an electrical, pneumatic or hydraulic actuator 29 and has a fully closed position, a partially open position, and a fully open position.

The bins 14 and 22, which are kept filled on the job site with appropriate materials by means of end loaders or grab buckets or the like, are provided with electrically controlled discharge valves, gates or doors 15A, 15B, 15C and 28, respectively, located at the discharge openings at the bottom of the bins and which are actuatable to open and closed positions to control material flow from the bins.

Figure 4:
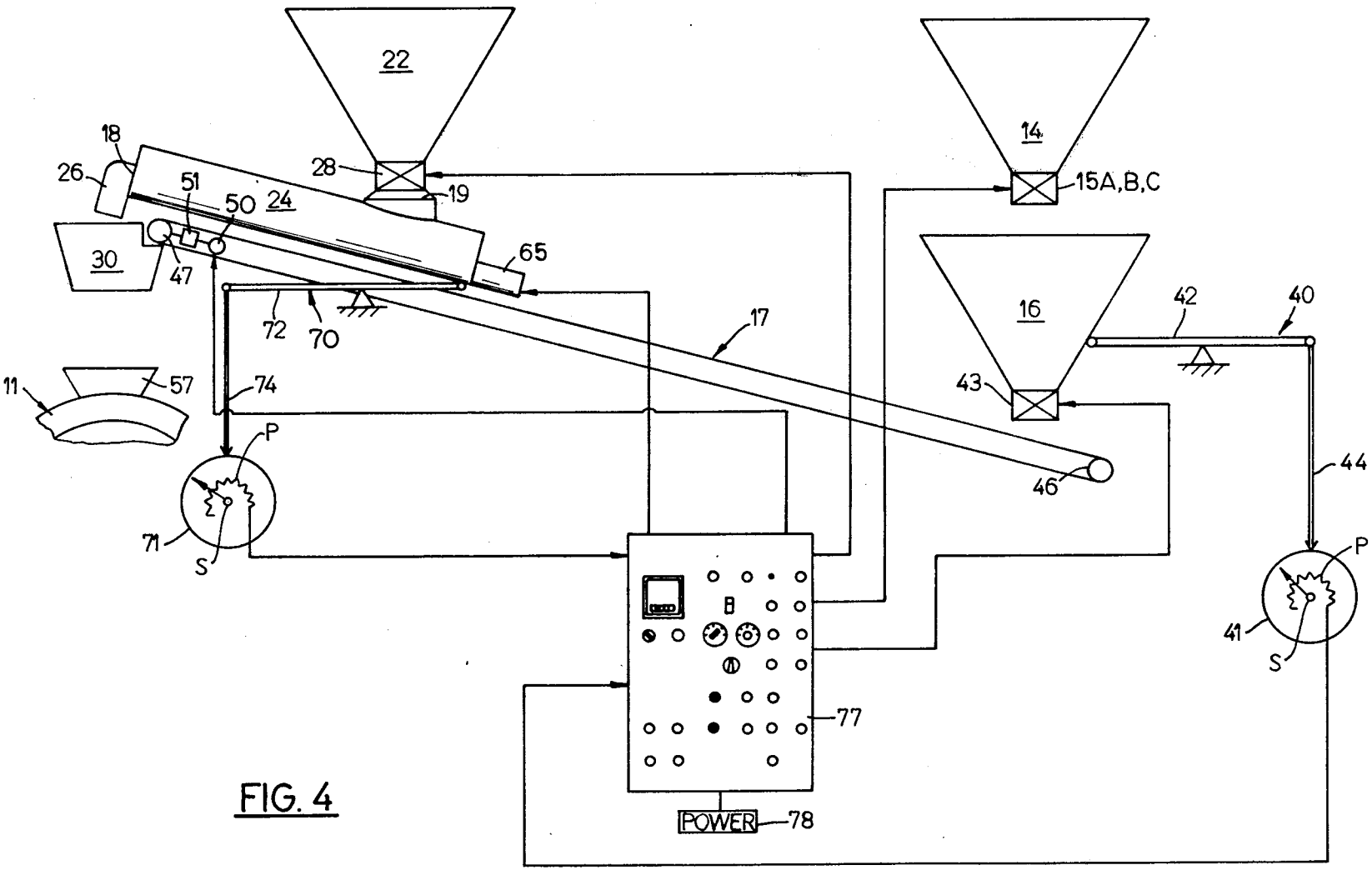
FIG. 4 is an elementary diagram of the control system of the plant shown in FIGS. 1 and 2.

As FIG. 4 shows, the conveyor motors 50 and 65, the two-stage fill valve 28 and the discharge (or fill) valves 15A, 15B, 15C and 43 are operated from a control panel 77 which is mounted on framework 12 and which is understood to have various control switches, such as conventional push button switches, which enable operation of plant 10 in the manual, semi-automatic or fully automatic mode, as hereinafter explained. Control panel 77 receives electric power from a suitable outside source 78 at a job site and distributes it within plant 10 as required.

Aggregate weigh bin 16 and combined screw conveyor-weigh batcher 24 are connected to conventional weigh scale means 40 and 70, respectively, in a known manner. The weigh scale means 40 and 70 include, for example, suitably arranged scale levers 42 and 72, respectively, from which bin 16 and conveyor 24 are suspended, and pull rods 44 and 74, respectively, connected thereto transmit load information to presetable scale dials 41 and 71, respectively. The dials 41 and 71 provide direct visual readouts of the batch weight of material in the weigh bin 16 and in the combined screw conveyor-weigh batcher 24, respectively. Furthermore, each dial is provided with suitable conventional means, such as a potentiometer P on the dial pointer shaft, to provide an electric output signal to control means in control panel 77 indicative of the weight of material. The electrical output signal from a scale dial is employed by the control means in control panel 77 to effect appropriate sequential operation of the valves 28, 15A, 15B, 15C, & 43 and the motors 50 and 65, as hereinafter described. Scale means and dials of the aforesaid character are conventional in the art.

Concrete batch plant 10 in accordance with the invention operates in the following manner. Assume that cement storage bin 22 and aggregate storage bin 14 have been filled to capacity with cement and aggregate, respectively, in a suitable manner. Further assume that the required batch weights of cement and aggregate are known to the operator and that the cement scale dial 71 and aggregate scale dial 41 have been set accordingly. Also assume that valves 28, 15A,15B,15C & 43 are closed and that the motors 50 and 65 are deenergized.

To carry out an automatic operation, the operator actuates the batch button on control panel 77 to energize drive motor 65 on screw conveyor 24 and simultaneously energize the two-stage valve 28 to fully open position. Cement then flows through valve 28 into the lower end of screw conveyor 24 and is moved thereby toward the discharge end. As the indicator on cement dial 71 moves toward the final selected batch weight, potentiometer P of dial 71 sends an electric signal to the control means in control panel 77 and the latter causes actuator 29 of the two-stage fill valve 28 to operate to partially close the fill valve gate, thereby permitting a controlled flow of cement into the screw conveyor 24 until the cement dial indicator 71 moves to the precise pre-set weight, whereupon valve 28 closes fully. The screw conveyor 24 is, for example, of such a length and diameter as to define a sufficient volume for batching up to 3500 lbs. of cement. When the required batch weight of cement is delivered to screw conveyor-weigh batcher 24, its drive motor 65 is deenergized by the automatic control means in panel 77.

While the cement is being batched, the discharge valves 15A,15B,15C are actuated sequentially to open position by control means in panel 77 and aggregate is also being deposited from bin 14 into and weighed in weigh bin or batcher 16. As the indicator on aggregate dial 41 moves to the final selected batch weight, potentiometer P of dial 41 sends an electric signal to the control means in control panel 77 and the latter causes discharge valves 15A,15B,15C to fully close. After this, the control means in control panel 77 causes the discharge valve 43 on weigh bin 16 to open and discharge a flow of aggregate onto conveyor 17. Conveyor motor 50 is energized before or simultaneously with opening of valve 43.

When the aggregate is discharged from weigh bin 16, the aggregate flows onto the upper side of belt conveyor 45 for transport to the discharge hood 30 for discharge through the opening 55 thereof. As the aggregate begins to flow into discharge hood 30, the drive motor 65 of the screw conveyor 24 is re-energized by the control means in control panel 77 to accomplish the discharge of cement from discharge outlet 18 of screw conveyor 24 into cement pipe 26 and into and through opening 55 in discharge hood 30 for delivery into mix truck 11. The screw conveyor 24 enables full control over the flow of cement as it is discharged therefrom, because the flites 63 in the screw conveyor exert a metering type action on the cement flowing into the cement pipe 26, and this precludes surging, which is a problem in conventional cement weigh hopper type systems. The concentric or central location of the cement pipe 26 with respect to the opening 55 in the discharge hood 30 permits the aggregate to encircle the cement and causes a certain amount of pre-mix action and minimizes the dusting as the materials are deposited in the loading hopper 57 of the transit mix truck 11.

After each batch of cement and aggregate has been weighed and delivered, the control means in control panel 77 effect reclosure of discharge valve 43 on bin 16 and stoppage of the conveyor motor 65 to place plant 10 in readiness for the next operation.

Control panel 77 enables operation of plant 10 in the manual mode wherein the operator relies on visual readings from the scales and energizes the various valves and conveyor motors in a desired sequence to operate the conveyors at desired speeds.

We claim:

1. In a concrete batch plant for supplying weighed batches of cement and aggregate to transit mixers: a discharge hood defining a discharge opening positioned to gravity feed a transit mixer; an aggregate storage bin; a cement storage bin; a weigh bin for receiving and weighing a batch of aggregate from said aggregate storage bin; a conveyor for receiving a weighed batch of aggregate from said weigh bin and for transporting the weighed batch of aggregate to said discharge hood for discharge through said discharge opening: a combined screw conveyor and weigh batcher having an inlet and outlet and adapted for receiving and weighing a batch of cement from said cement storage bin and for transporting a weighed batch of cement to said discharge hood for discharge through said discharge opening of said discharge hood concurrently with the discharge of said aggregate; and a multistage controllable valve between said cement storage bin and said inlet of said combined screw conveyor and weigh batcher for regulating the rate of flow of cement into the latter.

2. A plant according to claim 1 including a cement pipe disposed concentrically of said discharge opening of said discharge hood and connected to the outlet of said combined screw conveyor and weigh batcher.

3. In a concrete batch plant for supplying weighed batches of cement and aggregate to transit mixers: an elevated discharge hood defining a discharge opening positioned to gravity feed a transit mixer; an aggregate storage bin; a cement storage bin; a weigh bin below said aggregate storage bin for receiving and weighing a batch of aggregate from said aggregate storage bin; an upwardly inclined conveyor having a receiving end below said weigh bin and a discharge end associated with said discharge hood for receiving a weighed batch of aggregate from said weigh bin and for transporting a weighed batch of aggregate to said discharge hood for discharge through said discharge opening; an upwardly inclined combined screw conveyor and weigh batcher having an inlet below said cement storage bin and an outlet associated with said discharge hood for receiving and weighing a batch of cement from said cement storage bin and for transporting a weighed batch of cement to said discharge hood for discharge though said discharge opening of said discharge hood concurrently with discharge of said aggregate; and a multistage controllable valve between said cement storage bin and said inlet of said combined screw conveyor and weigh batcher for regulating the rate of flow of cement into the latter.

4. A plant according to claim 3 including a cement pipe disposed concentrically of said discharge opening of said discharge hood and connected to the outlet of said combined screw conveyor and weigh batcher.

5. In a mobile concrete batch plant for supplying weighed batches of cement and aggregate to transit mixers; an elevated discharge hood having a discharge opening positioned to gravity feed a transit mixer; and aggregate storage bin having a discharge valve; a cement storage bin having an adjustable multi-stage discharge valve; a weigh bin below said aggregate storage bin for receiving and weighing a batch of aggregate delivered from said discharge valve of said aggregate storage bin, said weigh bin having a discharge valve; an upwardly inclined conveyor having a receiving end below said weigh bin and a discharge end associated with said discharge hood for receiving a weighed batch of aggregate delivered from said discharge valve of said weigh bin and for transporting said weighed batch of aggregate to said discharge hood for discharge through said discharge opening; and an upwardly inclined combined screw conveyor and weigh batcher for receiving and weighing a batch of cement delivered from said adjustable discharge valve of said cement storage bin and for transporting a weighed batch of cement to said discharge hood for discharge through said discharge opening, said combined screw conveyor and weigh batcher having an inlet near its lower end connected to said adjustable discharge valve of said cement storage bin and having an outlet nears its upper end for feeding said discharge hood.

6. A plant according to claim 5 including a cement pipe disposed concentrically of said discharge opening in said discharge hood and connected to said outlet of said combined screw conveyor and weigh batcher.

7. In a mobile concrete batch plant for supplying weighed batches of cement and aggregate to transit mixers on a job site; a framework having a road transport position and a working position wherein one end of the framework is supported in elevated position and the other end of the framework is in a relatively low position; a discharge hood mounted near said one end of said framework and defining a discharge opening positioned to gravity feed a transit mixer when said framework is in working position; an aggregate storage bin mounted near said other end of said framework; a cement storage bin mounted near said one end of said framework; a weigh bin below said aggregate storage bin for receiving and weighing a batch of aggregate from said aggregate storage bin, a belt conveyor having a receiving end below said weigh bin and a discharge end associated with said discharge hood for receiving a weighed batch of aggregate from said weigh bin and for transporting a weighed batch of aggregate to said discharge hood for discharge through said discharge opening, said belt conveyor assuming an upwardly inclined disposition when said framework is in working position; a combined screw conveyor and weigh batcher having an inlet below said cement storage bin and an outlet associated with said discharge hood for receiving and weighing a batch of cement from said cement storage bin and for transporting a weighed batch of cement to said discharge hood for discharge through said discharge opening of said discharge hood concurrently with discharge of said aggregate, said combined screw conveyor and weigh batcher assuming an upwardly inclined disposition when said framework is in working position; and a multistage controllable valve between said cement storage bin and said inlet of said combined screw conveyor and weigh batcher for regulating the rate of flow of cement into the latter.

8. A plant according to claim 7 including a cement pipe disposed concentrically of said discharge opening of said discharge hood and connected to the outlet of said combined screw conveyor and weigh batcher.

9. A plant according to claim 7 including a cement pipe disposed concentrically of said discharge opening in said discharge hood and connected to said outlet of said combined screw conveyor and weigh batcher.

10. In a mobile concrete batch plant for supplying weighed batches of cement and aggregate to transit mixers; an elevated discharge hood having a discharge opening positioned to gravity feed a transit mixer; an aggregate storage bin having a discharge valve; a cement storage bin having a multistage discharge valve adjustable to fully open, partially open and fully closed positions; a weigh bin below said aggregate storage bin for receiving and weighing a batch of aggregate delivered from said discharge valve of said aggregate storage bin, said weigh bin having a discharge valve; aggregate weigh scale means connected to said weigh bin and capable of providing an output signal indicative of the weight of aggregate in said weigh bin; an upwardly inclined conveyor having a receiving end below said weigh bin and a discharge end associated with said discharge hood for receiving a weighed batch of aggregate delivered from said discharge valve of said weigh bin and for transporting said weighed batch of aggregate to said discharge hood for discharge through said discharge opening; a motor for driving said conveyor; an upwardly inclined combined screw conveyor and weigh batcher for receiving and weighing a batch of cement delivered from said adjustable discharge valve of said cement storage bin and for transporting a weighed batch of cement to said discharge hood for discharge through said discharge opening, said combined screw conveyor and weigh batcher having an inlet near its lower end connected to said adjustable discharge valve of said cement storage bin and having an outlet near its upper end for feeding said discharge hood; a motor for driving said combined screw conveyor and weigh batcher; cement weigh scale means connected to said combined screw conveyor and weigh batcher and capable of providing an output signal indicative of the weight of cement in said combined screw conveyor and weigh batcher; and control means for effecting operation of said discharge valves and said conveyor motor, said control means including means responsive to signals from said cement weigh scale means to adjust said multistage discharge valve from fully open to partially open position as a preselected concrete batch weight is approached and to fully close said multistage discharge valve when said preselected concrete batch weight is reached.

* * * * *